US006110603A

United States Patent [19]

Chen et al.

[11] Patent Number: 6,110,603

[45] Date of Patent: Aug. 29, 2000

[54] HARD-METAL OR CERMET BODY, ESPECIALLY FOR USE AS A CUTTING INSERT

[75] Inventors: Limin Chen, Oakmont, Pa.; Walter Lengauer, Leobendorf, Austria; Hans Werner Daub, Köln, Germany; Klaus Dreyer, Essen, Germany; Dieter Kassel, Witten, Germany

[73] Assignee: Widia GmbH, Essen, Germany

[21] Appl. No.: 09/342,966

[22] Filed: Jun. 29, 1999

[30] Foreign Application Priority Data

Jul. 8, 1998 [DE] Germany ..... 198 30 385
Oct. 2, 1998 [DE] Germany ..... 198 45 376

[51] Int. Cl.[7] ..... B32B 15/02

[52] U.S. Cl. ..... 428/564; 428/553; 428/548; 428/551

[58] Field of Search ..... 419/8, 38, 15, 419/12, 13, 18, 45, 58; 428/548, 551, 553, 564

[56] References Cited

U.S. PATENT DOCUMENTS 5,181,953 1/1993 Nakano ..... 75/237
5,529,804 6/1996 Bobbeau et al. ..... 427/217
5,652,045 7/1997 Nakamura et al. ..... 428/216
5,665,431 9/1997 Narasimhan ..... 427/255
5,702,829 12/1997 Paidassi et al. ..... 428/610

FOREIGN PATENT DOCUMENTS 0 603 143 6/1994 European Pat. Off. .
0 635 580 1/1995 European Pat. Off. .
0 687 744 12/1995 European Pat. Off. .
0 697 465 2/1996 European Pat. Off. .
27 17 842 10/1978 Germany .
39 36 129 5/1990 Germany .

*Primary Examiner*—Daniel J. Jenkins
*Attorney, Agent, or Firm*—Herbert Dubno

[57] ABSTRACT

A hard metal or cermet body, especially as a cutting insert, has a WC content in the hard phase making up at least 10% and at most 96% thereof and three layers or zones between the interior of the body and the surface formed by the heat treatment to which the sinterable body is subjected. In the outermost layer hard material with limited binder content can be formed underlain by an intermediate layer of a substantially pure WC—Co composition, the innermost layer having a tungsten content falling to the value in the body interior and a binder phase and Group IVa and Group Va metal which increased progressively to the levels in the body interior.

7 Claims, 3 Drawing Sheets

HARD-METAL OR CERMET BODY, ESPECIALLY FOR USE AS A CUTTING INSERT

FIELD OF THE INVENTION

Our present invention relates to a hard-metal or cermet body of the type which has a hard-material phase constituted of tungsten carbide and/or at least one carbide, nitride, carbonitride and/or oxycarbonitride of at least one element of Group IVa, Group Va, or Group VIa of the Periodic Table and a binder phase of iron, cobalt and/or nickel whereby the proportion of the binder phase in the body is 3 to 25% by mass (mass %) or by weight (weight %=mass %) and wherein the body is formed with an outer region having a plurality of layers of different compositions from one another and from the interior composition of the body and which can be formed by controlled treatment of the body when it is made.

More particularly, the invention relates to a body of this type which can be used as a cutting insert, i.e. a plate or the like which is affixed to a cutting tool for use in milling, turning, boring and other machining operations on workpieces which may be composed of steel or other metals.

The invention also relates to a method of making such a body and to the cutting inserts having a composition of such a body and to the use of such a body as a low-wear cutting member for such machining operations.

BACKGROUND OF THE INVENTION

Hard-metal or cermet bodies which are intrinsically formed with outer layers of different compositions from the interior of the body are described in EP 0 635 580 A1, EP 0 687 744 A2 and EP 0 822 265 A2.

EP 0 635 580 describes a sintered hard-metal alloy containing nitrogen which is comprised of a nickel and cobalt-containing binder phase and a hard material phase which is constituted by carbides of at least two kinds of transition metals from Groups IVa, Va and VIa of the Periodic Table. The binder phase to a depth of 3 $\mu$m from the surface has a concentration or proportion greater than 1.1 to 4 times than the binder phase proportion in the overall composition of the body. To greater penetration depths of up to 800 $\mu$m, the binder phase concentration decreases to a mean value for the overall composition. In the surface zone with a depth of at most 3 $\mu$m, the binder phase proportion is at most 10% below the highest value locally for the binder phase in the aforementioned region between 300 $\mu$m and 500 $\mu$m.

The hard-material phase has a metal composition $Ti_xW_yM_c$ in which M is a transition metal other than titanium or tungsten from Group IVa, Va or VIa of the periodic system. The composition satisfies the relationship $x+y+c=1$ whereby: $0.5<x\leqq 0.5$, $0.05<Y\leqq 0.5$ and $0.01<c\leqq 0.5$.

The titanium proportion in the surface zone in this system amounts to at least 1.01 times the mean titanium proportion in the overall alloy composition. The tungsten proportion in this surface region is between 0.1 and 0.9 times the mean tungsten proportion of the overall composition. Up to a penetration depth of 800 $\mu$m, the tungsten and the titanium proportions progressively vary until they reach the respective mean values. The region along the surface, i.e. the surface boundary zone region is either free from tungsten carbide particles or contains tungsten carbide particles in a low concentration which does not exceed 0.1 volume % of this region.

EP 0 687 744 A2 also describes a nitrogen-containing sintered hard-metal alloy which has a hard phase making up 75% by weight of the composition and at most 95% by weight thereof and which contains titanium, an element from Group VIa of the periodic system and tungsten carbide, the balance being a binder phase of nickel and cobalt.

The allow contains 5% by weight to 60% by weight titanium in the form of TiC and 30% by weight of 70% by weight of a metal in the form of the metal carbide. The atomic proportion of nitrogen with respect to the total of carbon and nitrogen in the hard phase is between 0.2 and 0.5. The hard-metal alloy has a soft surface layer which is comprised of the binder phase and tungsten carbide. Below this outermost layer there is a layer of 3 $\mu$m to 30 $\mu$m in thickness which is comprised substantially of tungsten carbide with reduced binder metal proportions.

EP 0 822 265 A2 describes still another nitrogen-containing sintered hard-metal alloy which includes a hard-material phase of tungsten carbide which also contains carbides, nitrides or carbonitrides of at least one of the elements of Group IVa, Group V or Group VIa of the periodic system or corresponding carbonitrides in addition to a binder phase which is primarily composed of nickel and cobalt. The described sintered body has a surface region which has three layers including an outermost layer with a tungsten carbide content between 0 to 30 volume %, the balance binder phase, an intermediate layer which consists of 50 volume % to 100 volume % tungsten carbide, balance binder phase, and a third, innermost, layer with a tungsten carbide proportion between 0 to 30 volume %, the balance binder phase. The outermost and innermost layers have thickness between 0.1 $\mu$m and 10 $\mu$m while the intermediate layer has a thickness between 0.5 $\mu$m and 10 $\mu$m.

The sintered bodies described above all have been indicated as useful as cutting tools because of improved mechanical characteristics.

OBJECTS OF THE INVENTION

It is the principal object of the present invention to further develop hard-metal or cermet bodies of the types described to enhance the utility of such bodies as cutting tools, increase resistance to wear and durability as cutting tools and, generally to improve such bodies for use as cutting inserts.

More particularly, it is an object of the invention to provide an improved hard-metal or cermet body which has greater resistance to wear and greater durability as a cutting tool than earlier sintered bodies.

Another object of the invention is to so improve the layering on a sintered hard-metal or cermet body of the type described that it will have improved results when the body is used as a cutting tool and whereby drawbacks of earlier hard-metal and cermet bodies are avoided.

Still another object of the invention is to provide a cutting insert for tools with improved properties and to provide an improved method of making a body or cutting insert which has improved properties over earlier systems and in particular greater wear resistance and durability of the cutting edge.

SUMMARY OF THE INVENTION

We have found that a hard-metal or cermet body can be formed intrinsically with a layer sequence which can impart significantly higher wear resistance and cutting-edge durability to the body when it is used as a cutting insert or in a cutting tool. According to the invention the hard-metal or cermet body is composed of a substrate having a hard-material phase selected from the group which consists of tungsten carbide, at least one carbide, nitride, carbonitride or oxycarbonitride of at least one of the elements of Group IVa, Va or VIa of the Periodic Table, and mixtures thereof, and a binder phase making up 3 to 25 mass-percent of the hard-material phase and consisting of at least one of the elements Fe, Co and Ni, and having a multilayer outer region formed by a succession of layers of different compositions.

According to the invention:

(a) the hard-material phase contains 10 mass-percent to 96 mass-percent WC;

(b) a first, outermost one of the layers forms a surface of the body and has a substantially binder-phase- free carbonitride phase to a depth between 2 μm and 30 μm from the surface;

(c) an intermediate one of the layers is disposed inwardly of and bounds the outermost layer, has a thickness of 5 μm to 150 μm, and is composed of a substantially pure WC—Co composition; and (d) an innermost one of the layers is disposed inwardly of the intermediate layer, has a thickness of at least 10 μm and at most 650 μm, and has proportions of the binder phase and any of the elements of Group IVa or Va of the Periodic Table which increase at a constant value to the proportions of the binder phase and any of the elements of Group IVa or Va of the Periodic Table in the substrate, and a proportion of tungsten which decreases at a constant value to the proportion of tungsten in the substrate.

The layers described merge with one another in a quasi-discontinuous manner and preferably a metal of the carbonitride phase is titanium. The content of titanium and/or a further element of Group IVa, Group Va or Group VIa of the periodic system, exclusive of tungsten, is a maximum in the outermost layer, falls sharply in the transition to the intermediate layer to a minimum value and increases in the transition to the third innermost layer until, at a tungsten depth measured from the surface of about 800 μm is generally equal to the mean proportion of the respective metals in the interior of the body which, however, lies below the titanium or the respective other metal proportion in the outer layer.

In a corresponding manner, the nitrogen content in the intermediate layer is a minimum and increases at the transition to the outermost layer to a proportion which is above the average nitrogen content of the alloy in the interior of the body. By contrast, the contents of tungsten and cobalt rise significantly at the transition from the outermost layer to the intermediate layer. The hard-material phase WC can optionally be formed at the sintering stage from (Ti,W)C or (Ti,W)(C,N). Furthermore, the tungsten in the WC phase can be completely or partly replaced by MoC which can be formed upon sintering from (Ti,Mo)C or (Ti,Mo) (C,N).

Preferably the components of the binder phase are present in the intermediate layer in a proportion which is a maximum of 0.9-times the proportion of the components of the binder phase in an interior of the body and/or the tungsten proportion in the intermediate phase is at least 1.1-times the tungsten proportion in the interior of the body.

According to another aspect of the invention the hard metal or cermet body can distinguish over the art in that:

(a) the hard-material phase contains 10 mass-percent to 96 mass-percent WC;

(b) an outermost surface or edge zone with a depth of 1 μm to a maximum of 3 μm bounds a first layer having a depth of 10 μm to 200 μm and in which the tungsten and binder-phase proportions are a maximum of 0.8-times the overall tungsten and binder-phase proportions of the body, the tungsten and binder-phase proportions substantially continuously increase toward an interior of the body, a nitrogen proportion in the first layer decreasing substantially continuously toward the interior of the body;

(c) an intermediate layer lies beneath the first layer and has a thickness between 20 μm and 400 μm, tungsten and binder-phase proportions which increase with increasing penetration depth to a maximum for the body, and a proportion of elements of Group IVa and/or Group Va of the Periodic Table which decreases to a minimum for the body; and (d) a third, innermost layer with a penetration depth of a maximum of 1 mm as measured from the surface of the body and in which tungsten and binder-phase proportions decrease to substantially constant values thereof in the interior of the body and the proportion of elements of Group IVa and/or Group Va elements increase to a substantially constant value thereof in the interior of the body.

This definition of the invention recognizes that there are no sharp separations between the individual layers or zones. Rather the respective metal and nonmetal components have proportions in the alloy which can vary over wide transition ranges. This alloy is also characterized by the fact that the tungsten carbide proportion in the hard material phase makes up at least 10 mass % thereof to a maximum of 96 mass % thereof.

The compositions which have been described can have their hard-material phase and/or their binder phase contain chromium and/or molybdenum in amounts up to 2 mass % of the total mass of the body. Furthermore, the hard-material phase can contain TiCN preferably in an amount between 3 mass % and 40 mass %.

A method of making the hard-metal or cermet body can comprise the steps of:

(a) forming a nitrogen-free starting mixture of particulate substances capable of forming a hard-material phase selected from the group which consists of tungsten carbide, at least one carbide, nitride, carbonitride or oxycarbonitride of at least one of the elements of Group IVa, Va or VIA of the Periodic Table, and mixtures thereof, and a binder phase making up 3 to 25 mass-percent of the hard-material phase and consisting of at least one of the elements Fe, Co and Ni, and such the hard-material phase contains 10 mass-percent to 96 mass-percent WC;

(b) shaping the nitrogen-free starting mixture into a green body and heating the green body to at least 1200° C. in a vacuum or in an inert gas atmosphere;

(c) thereafter introducing nitrogen-containing gas and optionally carbon-containing gas at least intermittently into the atmosphere with a gas pressure of $10^3$ to $10^7$ Pa while the green body is at the temperature of at least 1200° C.;

(d) then heating the green body to a temperature sufficient to sinter it and sintering the green body into a sintered body over a period of at least 0.5 h; and (e) thereafter cooling the sintered body while maintaining the nitrogen-containing atmosphere in contact with the sintered body and as established in step (c) at least until the sintered body has been cooled below 1000° C.

In this system, starting with a nitrogen-free mixture the binder metals can preferably be nickel and/or cobalt and the mixture can be milled to intimately blend the particles with one another. The sintering time is preferably about 1 hour and the gas pressure is preferably between $10^4$ Pa to $5\times10^4$ Pa.

When up to 2 mass % nitrogen, based on the total mass of the starting mixture, is provided in the starting mixture, the method can comprise the steps of:

(a) forming a starting mixture containing at least 0.2 mass-% nitrogen, based on the total mass of the starting mixture, of particulate substances capable of forming a hard-material phase selected from the group which consists of tungsten carbide, at least one carbide, nitride, carbonitride or oxycarbonitride of at least one of the elements of Group IVa, Va or VIA of the Periodic Table, and mixtures thereof, and a binder phase making up 3 to 25 mass-percent of the hard-material phase and consisting of at least one of the elements Fe, Co and Ni, and such the hard-material phase contains 10 mass-percent to 96 mass-percent WC;

(b) shaping the starting mixture into a green body;

(c) heating the green body to a sintering temperature in a vacuum or in an inert gas atmosphere;

(c) adjusting the composition of the atmosphere during the heating of the green body by introducing nitrogen-containing gas and optionally carbon-containing gas at least intermittently into the atmosphere with a gas pressure of $10^3$ to $10^7$ Pa from when the green body reaches a temperature of 1200° C. until the green body is at the sintering temperature;

(d) then sintering the green body at the sintering temperature into a sintered body over a period of at least 0.5 h; and (e) thereafter cooling the sintered body while maintaining the nitrogen-containing atmosphere in contact with the sintered body and as established in step (c) at least until the sintered body has been cooled below 1000° C.

Of course, steps which apply to the nitrogen-free mixture can also be used where the mixture contains at least 0.2 mass % nitrogen.

Especially where quasidiscontinous transitions between the individual layers or zones are to be formed, the described method can further comprise the step of:

(f) varying the temperature of the body during the sintering thereof or subsequent to sintering during cooling thereof to cause the temperature of the body to pass at least once through a eutectic melting point of the body.

The temperature can be varied in step (f) so as to oscillate between at least 20° C. (preferably at least 50° C.) above and at least 20° C. (preferably at least 50° C.) below the eutectic melting point.

According to a feature of the invention before the temperature is raised to its maximum or reduced to its minimum during the temperature oscillations, the temperature can be held constant for a brief period of time and at the temperature maxima and minima, the temperature can also be held constant for brief periods of time.

In a concrete embodiment, after sintering for 0.5 hours, the temperature is reduced to the eutectic melting point and then raised by 50° C. then lowered to a value of 50° C. below the eutectic point and then raised and lowered again after a brief hiatus so that the temperature undergoes four heating and cooling cycles before the body is finally brought to room temperature. The heating and cooling rates to reach the sintering temperature and cool the body from the sintering temperature and the rate at which heating and cooling can occur during the temperature oscillation can be up to 10° C./min. Preferably the temperature variation speed can lie between 3° C./min and 5° C. per min.

After sintering the body can be subjected to hot eutectic pressing to form the final dimensions of the body which may form the final shape of the cutting insert.

BRIEF DESCRIPTION OF THE DRAWING

The above and other objects, features, and advantages will become more readily apparent from the following description, reference being made to the accompanying drawing in which.

SPECIFIC DESCRIPTION

Figure 5:
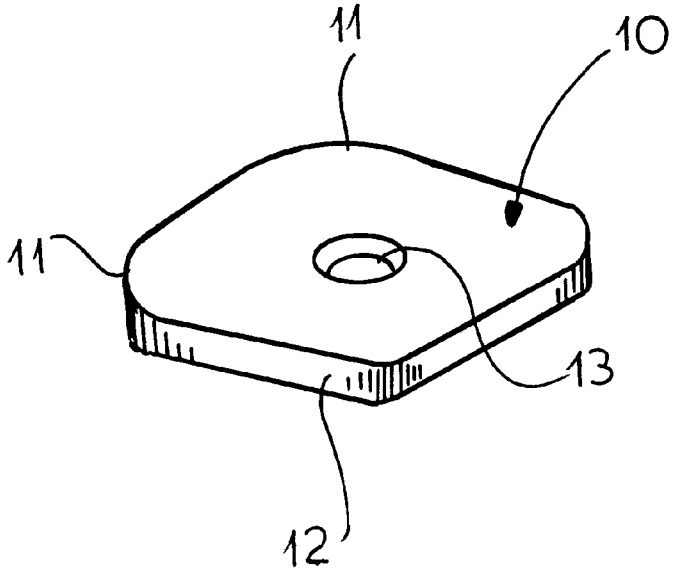
FIG. 5 is a perspective view of a cutting insert formed as a hard metal or cermet body according to the invention.
Figure 6:
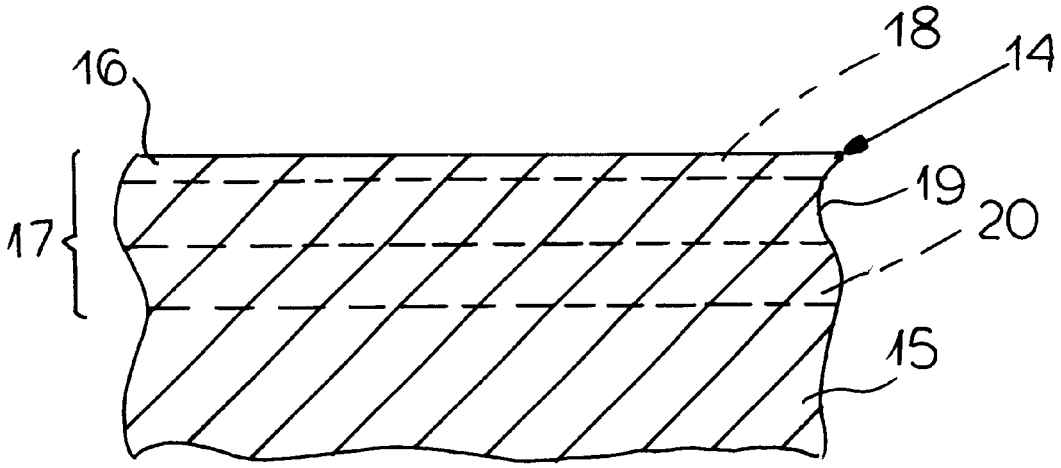
FIG. 6 is a diagrammatic cross section through such a body.

As can be seen from FIG. 5, a cutting insert 10 may have cutting edges 11 formed on the surface of a body 12 having a hole 13 through which a screw can pass to hold the insert in place on a tool holder for a lathe, or a milling body for a milling machine cutter, or the like. As can be seen from FIG. 5, the body 14 can have an interior portion 15 and a surface 16, the latter forming the cutting edge and a variation in composition through the surface zone 17. This variation in composition can define at least three layers, for example an outermost layer 18 of a thickness of 2 $\mu$m to 30 $\mu$m, a second or intermediate layer 19 having a thickness of 5 $\mu$m to 150 $\mu$m and an innermost layer 20 having a thickness of at least 10 $\mu$m and at most 650 $\mu$m. The outermost layer 18 can be a binder-free or substantially binder-free carbonitride phase, the intermediate layer 19 can be composed of a substantially pure tungsten carbide, cobalt composition and the innermost layer 20 can have proportions of the binder phase and a Group IVa or Group Va metals increase toward the interior and a tungsten proportion decreasing toward the interior.

Figure 2:
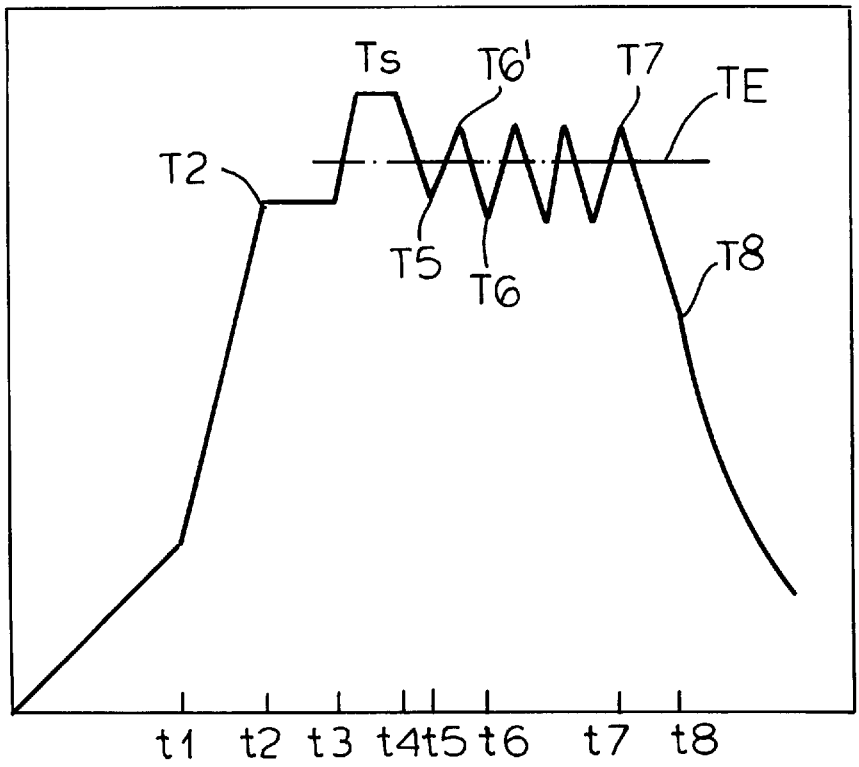
FIG. 2 is a graphic illustration of the variation of temperature with time during the heating of a preformed body to the sintering temperature and the temperature variation in the cooling phase in a method according to the invention.

In a first embodiment, 6.5 grams of a powder mixture of 70% TiC and 30% TiN, 13.5 grams of a mixture of equal parts of TiC and TiN and 80 grams of tungsten carbide and 11.1 grams of cobalt are mixed together, milled and pressed into a green body. This green body is then introduced into a sintering autoclave and subjected to a temperature pattern as shown in FIG. 2 in which the temperature is plotted along the ordinate against time along the abscissa.

First the green body is heated over a period of 6 hours to a time point t1 at heating rate of 1.2° C./min. From this point the green body is heated up at a heating speed of 5° C./min for a period of about 9 hours to the time point t2 at which a temperature T2 of 1260° C. is reached. The heating to this point is under vacuum or a reduced pressure of say 10 Pa.

While the green body is held at a temperature of 1260° C. in an autoclave, nitrogen is admitted under a pressure of $5\times10^4$ Pa. This sintering atmosphere is maintained at a constant temperature for a period of 2 hours until the time point t3 is reached.

The nitrogen atmosphere is pumped off and a vacuum or a pressure of about 10 Pa is restored before the body is heated at a rate of 5° C./min to the sintering temperature of 1520° C. The sintering temperature TS is maintained for an hour (time point t4), whereupon the body is cooled at a rate of 3.3° C./min to 1250° C. at a temperature t5.

At this point nitrogen is introduced at a pressure of $5\times10^4$ Pa into the sintering autoclave and the body is heated up again at a rate of 33° C./min to a temperature t6' of 1400° C. before it is cooled again to a temperature of 1200° C. (T6 at a time point t6). This temperature oscillation is repeated a total of 4 times, it being understood that the oscillation is at least 50° C. in either direction around the eutectic melting point which has been represented at TE in FIG. 2. The nitrogen atmosphere at the pressure of $5\times10^4$ Pa is maintained during this temperature oscillation.

Figure 1:
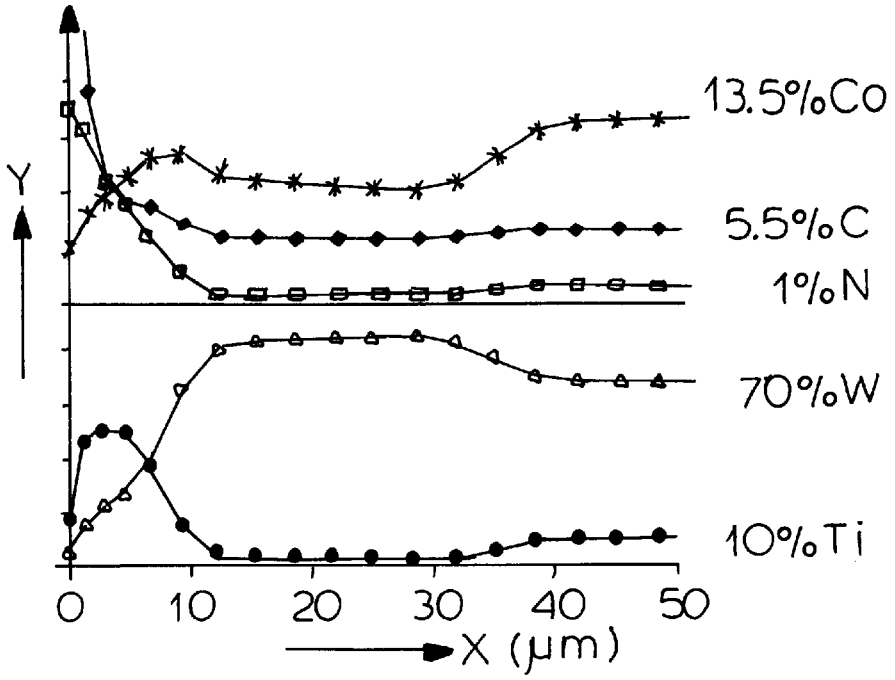
FIG. 1 is a graphic illustration of the relationship between metal and nonmetal proportions as a function of penetration depth of a first alloy body according to the invention.

Finally at the time point t7, from the temperature T7, the sintered body is cooled to a temperature T8 of about 1000° C. with a cooling rate of 3.3° C./min before a time t8, the controlled heating or cooling is terminated and the furnace then fully cooled. The total process can be about 26 hours. This process yields a body having a composition plotted at Y in weight % (equivalent to mass %) against depth X (plotted along the abscissa in $\mu$m) measured from the surface of the body. The outermost layer consists substantially exclusively of TiCN and neither tungsten nor cobalt as a binder can be detected in this outermost layer in any significant amount. In an intermediate layer, inwardly of this outermost layer, there is a practically pure hexagonal WC—Co structure (without TiCN components). As can be seen from FIG. 1, the titanium content and the nitrogen content falls in a boundary region from the outermost layer to the intermediate layer sharply and increases again until in the boundary region between the intermediate layer and the innermost layer. In the transition region from the intermediate layer to the outermost layer, the tungsten content drops to an intermediate value while the cobalt content rises to an intermediate value. With penetration depths greater than 50 $\mu$m the concentrations shown at the right hand side of the graph apply.

Figure 4:
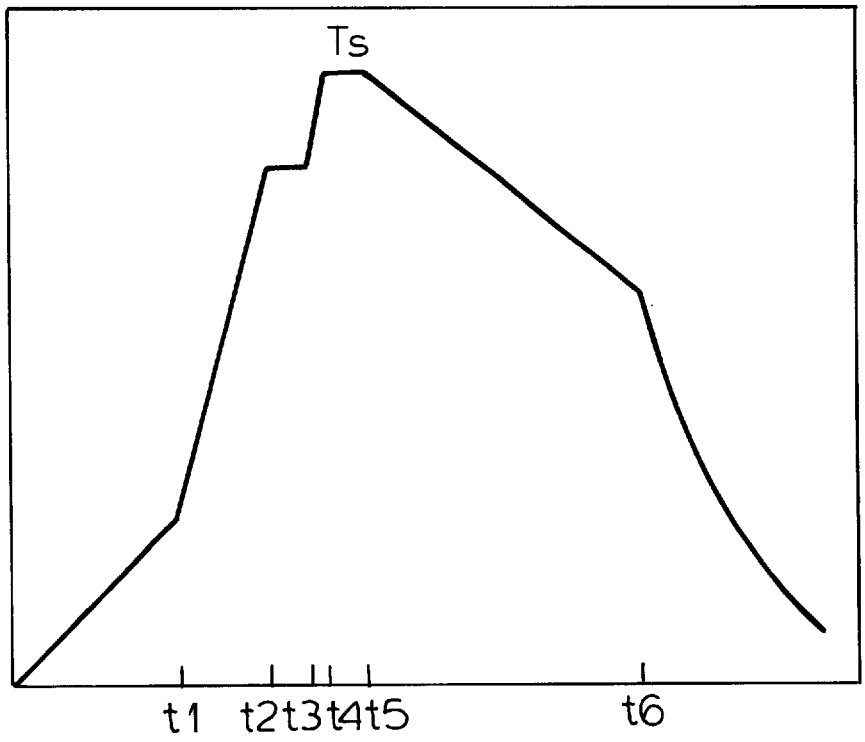
FIG. 4 is a graph showing the temperature variation with time before, during and after sintering.

In a second embodiment 14.5 grams of a mixture of 70% TiC and 30% TiN, together with 28.5 grams of a mixture of equal parts of TiC and TiN with 57 grams WC and 11.1 grams Co are milled together and then pressed to form a green body. This green body is subjected to sintering with a temperature pattern as shown in FIG. 4 in a sintering autoclave.

Initially the body is heated over a period of about 6 hours (time point t1) with a heating speed of 1.2° C./min. The heating rate is then increased to 5° C./min until the temperature of 1260° C. is reached (time point t2). This temperature is maintained for one hour (time point t3), whereupon the body is heated at a rate of 5° C./min to 1500° C. at the time point t4. This sintering temperature TS is maintained for about an hour.

Until t4 a vacuum or minimum pressure of 10 Pa is maintained in the sinter autoclave. Upon reaching the sinter temperature of 1500° C., nitrogen is introduced at a pressure of $5\times10^4$ Pa. The nitrogen atmosphere is maintained until the end of the process.

After an hour at the sintering temperature (time t5), the sintered body is cooled with a speed of 1° C./min until the temperature of about 1000° C. is reached at time t6. The controlled heating/cooling is then terminated and the furnace cooled to room temperature.

Figure 3:
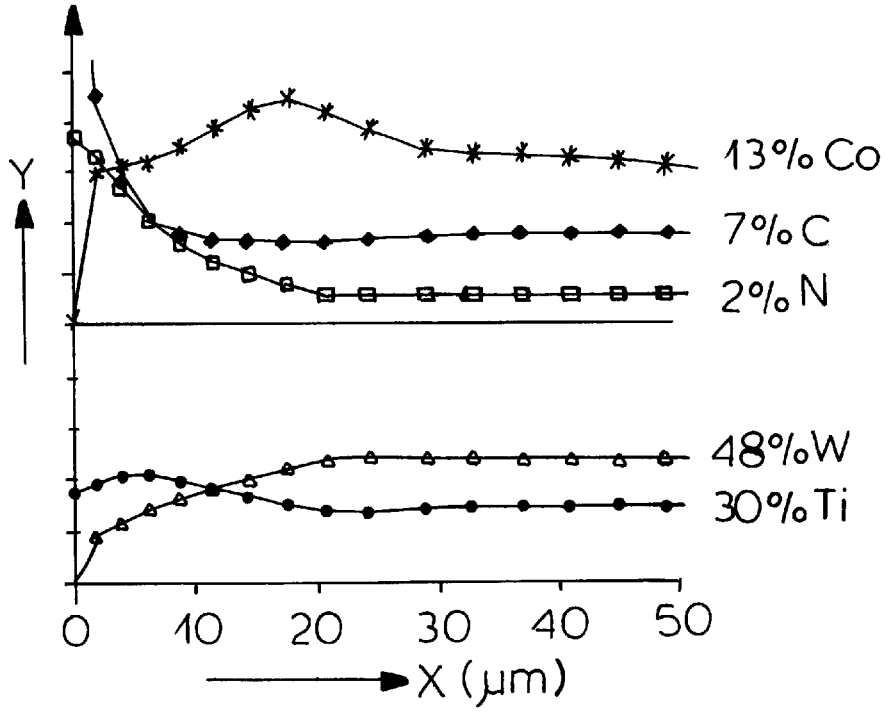
FIG. 3 is a view similar to FIG. 1 for another alloy body according to the invention.

The composition of the body which results from this process has been shown in FIG. 3 in which the concentration in % is plotted along the ordinate Y for each of the elements Co, C, N, W and Ti of the composition against the penetration depth plotted in $\mu$m along the abscissa X.

From this Figure it will be apparent that there is a thin boundary layer with a thickness of a maximum of 1 $\mu$m to 3 $\mu$m which is not significant to the invention and which is followed by a first zone or layer with reduced or negligible tungsten and cobalt contents which increase continuously with increasing penetration depth and reach a maximum in an intermediate layer. In the same way that the tungsten and cobalt contents pass through a maximum in the intermediate layer, the titanium content passes through a minimum in the intermediate layer. In the same way that the tungsten and cobalt contents pass through a maximum in the intermediate layer, the titanium content passes through a minimum in the intermediate layer. In the transition region from this intermediate layer to the innermost layer which can extend to a depth of about 1 mm in the body, the tungsten and cobalt contents fall to intermediate values prevailing in the interior of the body and corresponding to the overall proportion of tungsten and cobalt in the original mixture. The titanium content correspondingly increases inwardly toward the interior of the body. The nitrogen content falls (apart from the titanium content) in a surface layer which has a thickness of at most 3 $\mu$m, with increasing penetration depth continuously and reaches at a depth of about 50 $\mu$m, the mean value established by the original position.

The mean value of the concentrations of the respective elements are given in weight % along the right hand side of the graph. The two embodiments described of cermets according to the invention differ as can be seen by comparing FIGS. 1 and 3 in the transition from the outermost layer to the intermediate layer and from the intermediate layer to the innermost layer. In the first case the transitions are quasidiscontinuous with relatively sharp rising and falling flanks of the contents of the metals and nonmetals in the transition region. The transitions in the second embodiment are significantly less steep and with reduced gradients.

The invention is also applicable to hard metal compositions such as a starting mixture formed by 53 to 66 grams WC, 4 to 17 grams W, 30 grams TiC and 11.1 grams Co. It is also possible with the invention to use hard materials of the type (Ti, W)C, (Ti,W) (C,N) or WC, TiC, TiN or WC, C and Co in respective mixtures with cobalt or nickel as binder metals where required. The treatment and compositions can determine the compositions in turn of the three layers along the surface of the body and the respective thicknesses.

We claim:

1. A hard-metal or cermet body composed of a substrate having a hard-material phase selected from the group which consists of tungsten carbide, at least one carbide, nitride, carbonitride or oxycarbonitride of at least one of the elements of Group IVa, Va or VIA of the Periodic Table, and mixtures thereof, and a binder phase making up 3 to 25 mass-percent of the hard-material phase and consisting of at least one of the elements Fe, Co and Ni, and having a multilayer outer region formed by layers of different compositions, wherein:

(a) the hard-material phase contains 10 mass-percent to 96 mass-percent WC;

(b) a first, outermost one of said layers forms a surface of said body of a substantially binder-phase- free carbonitride phase to a depth between 2 $\mu$m and 30 $\mu$m from said surface;

(c) an intermediate one of said layers is disposed inwardly of and bounds said outermost layer, has a thickness of 5 μm to 150 μm, and is composed of a substantially pure WC—Co composition; and (d) an innermost one of said layers is disposed inwardly of said intermediate layer, has a thickness of at least 10 μm and at most 650 μm, and has proportions of the binder phase and any of said elements of Group IVa or Va of the Periodic Table which increase to a substantially constant value to the proportions of the binder phase and any of said elements of Group IVa or Va of the Periodic Table in said substrate, and a proportion of tungsten which decreases to a substantially constant value of the proportion of tungsten in said substrate.

2. The hard-metal or cermet body defined in claim 1 wherein components of the binder phase are present in said intermediate layer in a proportion which is a maximum of 0.9-times the proportion of said components of the binder phase in an interior of the body and/or the tungsten proportion in said intermediate phase is at least 1.1-times the tungsten proportion in the interior of the body.

3. The hard-metal or cermet body defined in claim 1 wherein said layers have a nitrogen proportion which increases at least regionally from the outermost boundary of the intermediate layer outwardly to the outermost layer.

4. A hard-metal or cermet body composed of a substrate having a hard-material phase selected from the group which consists of tungsten carbide, at least one carbide, nitride, carbonitride or oxycarbonitride of at least one of the elements of Group IVa, Va or VIA of the Periodic Table, and mixtures thereof, and a binder phase making up 3 to 25 mass-percent of the hard-material phase and consisting of at least one of the elements Fe, Co and Ni, and having a multilayer outer region formed by layers of different compositions, wherein:

(a) the hard-material phase contains 10 mass-percent to 96 mass-percent WC;

(b) an outermost surface or edge zone with a depth of 1 μm to a maximum of 3 μm bounds a first layer having a depth of 10 μm to 200 μm and in which the tungsten and binder-phase proportions are a maximum of 0.8-times the overall tungsten and binder-phase proportions of the body, the tungsten and binder-phase proportions substantially continuously increase toward an interior of said body, a nitrogen proportion in said first layer decreasing substantially continuously toward said interior of said body;

(c) an intermediate layer lies beneath said first layer and has a thickness between 20 μm and 400 μm, tungsten and binder-phase proportions which increase with increasing penetration depth to a maximum for the body, and a proportion of elements of Group IVa and/or Group Va of the Periodic Table which decreases to a minimum for the body; and (d) a third, innermost layer with a penetration depth of a maximum of 1 mm as measured from the surface of the body and in which tungsten and binder-phase proportions decrease to substantially constant values thereof in the interior of said body and the proportion of elements of Group IVa and/or Group Va elements increase to a substantially constant value thereof in the interior of the body.

5. The hard-metal or cermet body defined in claim 1 or claim 4 wherein said hard-material phase and/or said binder phase contain chromium and/or molybdenum in amounts up to 2 mass percent of the total mass of the body.

6. The hard-metal or cermet body defined in claim 1 or claim 4 wherein the hard-material phase contains TiCN in an amount between 3 mass-% and 40 mass %.

7. The hard-metal or cermet body defined in claim 1 or claim 4 wherein said hard-material phase contains up to 40 mass-% TiC and/or TiC.

* * * * *